United States Patent [19]

Stievenart et al.

[11] 3,947,856

[45] Mar. 30, 1976

[54] EQUIPMENT FOR CONTROLLING THE SUPPLY OF FRESH LIQUID IN LIQUID TREATMENT OF PHOTOGRAPHIC EMULSION CARRIERS

[75] Inventors: Emile Frans Stievenart, Hoboken, Antwerp, Belgium; Jürgen Müller, Munich; Werner Stahl, Unterhaching, both of Germany

[73] Assignee: AGFA-GEVAERT AG, Leverkusen, Germany

[22] Filed: Feb. 5, 1974

[21] Appl. No.: 439,760

[30] Foreign Application Priority Data

Feb. 17, 1973 Germany ..... 2307986

[52] U.S. Cl. ..... 354/324

[51] Int. Cl.[2] ..... G03D 3/02

[58] Field of Search ..... 354/297, 298, 316, 319, 354/320, 324, 331, 336; 134/57

[56] References Cited

UNITED STATES PATENTS

| | | | |
|---|---|---|---|
| 3,334,566 | 8/1967 | Friedel | 354/336 |
| 3,368,472 | 2/1968 | VanBouwel et al. | 354/336 X |
| 3,597,075 | 8/1971 | Kobayashi | 354/297 X |
| 3,650,196 | 3/1972 | Hosoe et al. | 354/324 |
| 3,712,203 | 1/1973 | Kishi et al. | 354/324 X |

*Primary Examiner*—Fred L. Braun

*Attorney, Agent, or Firm*—Michael J. Striker

[57] ABSTRACT

A bath container for liquid treatment of a photographic emulsion carrier has a refill bottle which automatically adds fresh liquid to maintain the liquid level. An overflow maintains the maximum liquid level. A pump having an intake as far removed as possible from the refill bottle serves to circulate the liquid. It further serves to forceably remove liquid from the container corresponding to the quantity of emulsion carrier processed. The signal signifying the quantity of processed emulsion carrier is furnished by a selector switch while scanning the emulsion carrier and connects a capacitor to a constant current source in the presence of the emulsion carrier and to a discharge circuit, in turn connected to circuits which energize the exhaust pump operation, in the absence of the emulsion carrier. Further circuits directly connected to the capacitor serve to energize the exhaust pump operation when the voltage across the capacitor has reached a predetermined voltage.

15 Claims, 4 Drawing Figures

EQUIPMENT FOR CONTROLLING THE SUPPLY OF FRESH LIQUID IN LIQUID TREATMENT OF PHOTOGRAPHIC EMULSION CARRIERS

BACKGROUND OF THE INVENTION

The invention relates to equipment for liquid treatment of photographic emulsion carriers. Such equipment comprises a bath container having a refill arrangement and an overflow for maintaining a particular liquid level. It further has a regenerative arrangement for adding treatment agent corresponding to the amount of surface area of the photographic emulsion carrier which is to be treated or has been treated.

In conventional equipment of the above-described type, the refill arrangement serves to maintain a minimum liquid level while the overflow prevents an excessive liquid level from existing. The desired level can thus be maintained relatively exactly. The refill arrangement is, in general, controlled by a scan arrangement in the path of the photographic emulsion carrier, so that corresponding liquid quantities may be added, for example by a metering pump. However, these metering pumps are very expensive. In simpler equipment of the above-described type, the refill arrangement is limited to replacing the liquid lost by being carried away by the emulsion carrier. In this type of arrangement of course the amount of liquid added per unit of surface of the emulsion carrier depends upon how much liquid is carried away by the emulsion carrier. The quantity of fresh concentrate can thus not be reliably determined.

SUMMARY OF THE INVENTION

It is an object of the present invention to furnish a system wherein any arbitrary desired amount of fresh liquid per unit of emulsion carrier, that is per unit of surface of the emulsion carrier or per unit quantity of emulsion carrier being processed may be added to the bath in which the processing of the emulsion carrier takes place.

In accordance with the present invention, scan means are provided which scan the emulsion carrier and furnish a control signal when the quantity of so-scanned emulsion carrier has reached a predetermined quantity. Further, means are provided for forceably removing a determined quantity of liquid corresponding to the quantity of so-scanned emulsion carrier from the bath container in response to the control signal. Refill means are then provided which refill the bath container with a quantity of fresh liquid corresponding to the determined quantity of liquid removed from the bath container.

The removal of liquid from the bath container by means of removing means such as, for example, a pump, may be readily accomplished under control of the scan means. The refill arrangement is of course present in any case and automatically then replaces the so-removed quantity of liquid.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
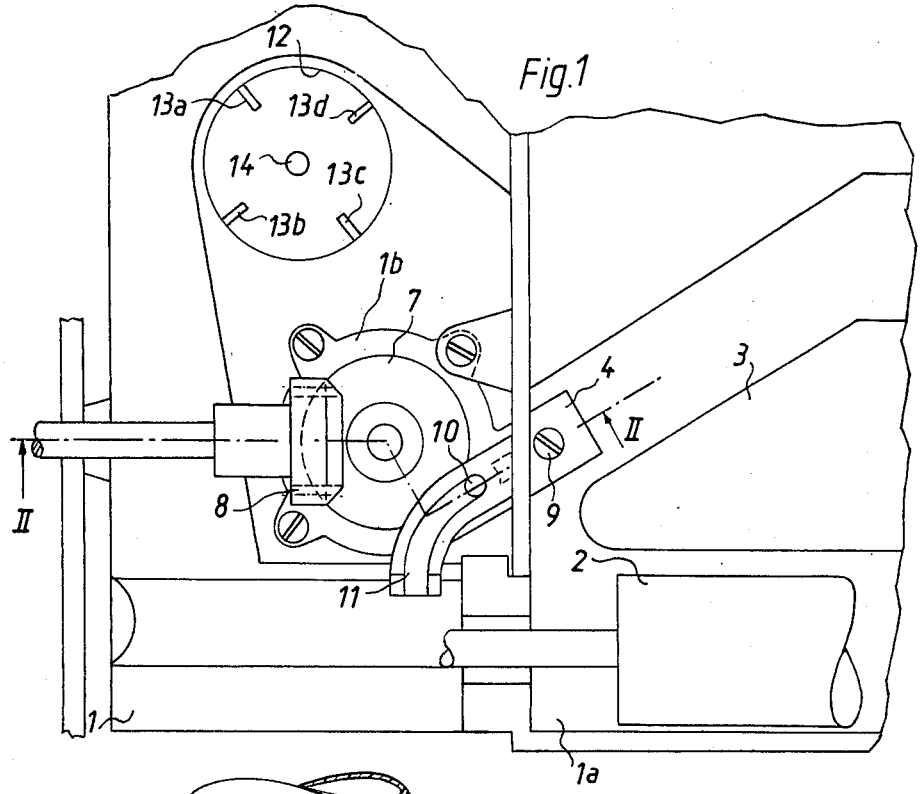
FIG. 1 shows a portion of the liquid treatment arrangement for emulsion carriers, including a circulating arrangement and a refill system.

DESCRIPTION OF THE PREFERRED EMBODIMENTS:

A preferred embodiment of the present invention will now be described with reference to the drawing.

Figure 2:
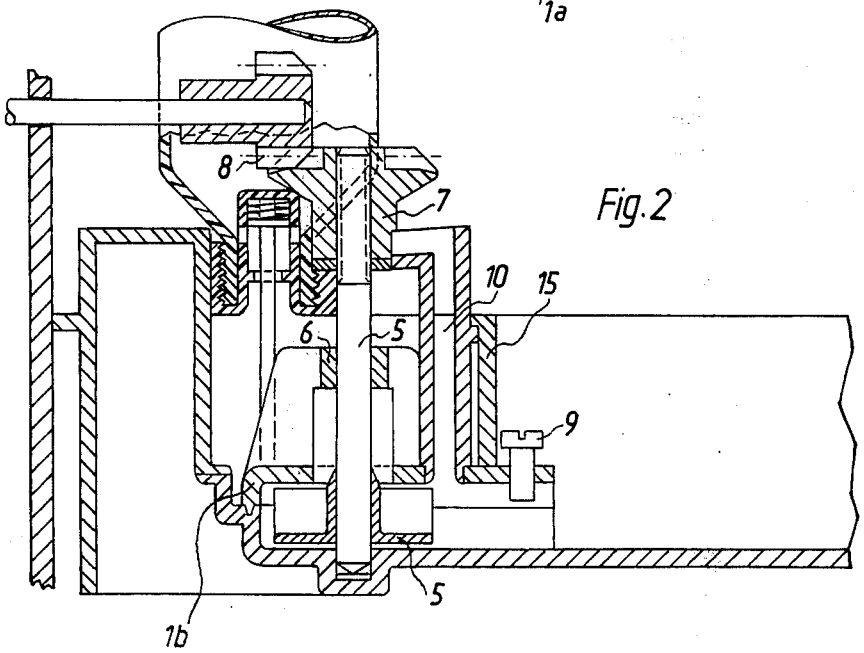
FIG. 2 shows a lengthwise section of the arrangement of FIG. 1, along lines II—II.

In FIG. 1, reference numeral 1 refers to a machine frame which has a trough-shaped container 1*a* as a treatment chamber. Positioned within the chamber are pairs of cylinders which serve to transport the emulsion carrier through the container. Only cylinder 2 is shown. The cylinders and the drives for the cylinders are conventional and need not be shown in detail here. Positioned within container 1*a* is a guide element 3 which allows liquid exiting a pipe 4 in the direction of the lengthwise axis of the equipment to circulate on one of the walls of the container until the stream of liquid is reflected by the container end to the intake side of the circulating arrangement. As shown in FIG. 2, the circulator means, in a preferred embodiment of the present invention, is a centrifugal pump 5 having a vertical axle. The pump has substantially radial vanes and is covered by housing portion 1*b*. Axle 5 passes through a bearing 6 at a determined height over housing 1*b* and, at its upper end, has a bevel gear 7 which cooperates with a further bevel gear 8 driven by a motor.

The AC motor driving the pump has two windings which, in a preferred embodiment of the present invention, have different number of turns. The windings are separately connectable to a current source so that, depending upon the connection, the motor furnishes a smaller or greater output thus causing pump 5, for a corresponding backpressure, to furnish a greater or lesser pump output.

Housing 1*b* is a volute chamber, whose exit pipe 4 is tangential to the axle of the pump in a predetermined region. A screw 9 serves to adjust the cross-section of exit or exhaust pipe 4 shortly before the final exit into the treatment chamber 1*a*. Decreasing the cross-sectional area by means of screw 9 causes a backpressure to be developed between pump 5 and set screw 9 which varies with the pump output power. Screw 9 is herein referred to as adjusting means. Further, in this region, a branch connection is furnished which is connected to a riser 10. This riser or ascending pipe terminates above the liquid level and ends in an open discharge channel 11 which in turn conducts the fluid to a container for used up liquid.

A refill arrangement 13 is also positioned within the frame 1, but at the maximum possible distance away from pump 7. These refill means or refill arrangement comprise a bottle having an opening at the bottom, the flow of liquid through the opening being controlled by a spring-loaded valve. Specifically, the bottle is inserted through the inside surface of a bore and mounted on spoke-like supporting surfaces 13*a*, *b*, *c* and *d*. A key 14, mounted in the housing and vertically in the center of the bore serves to push the valve upward so that liquid can flow from the bottle. Surfaces 13*a–d* are arranged at a level which corresponds to the level of treatment liquid in container 1*a*. The chamber with pump 5 and refill arrangement 13 serves as an antechamber and is separated from the trough-like chamber 1*a* by an overflow baffle 15. This arrangement of separating the liquid containers into an antechamber and trough with a pump which pumps the liquid from the antechamber into the trough serves, as taught in German patent No. P 22 19 110.2, to effect a very constant liquid level with respect to time in the trough, while also serving to effect a circulation of all the liquid with very economical and exactly dosed addition of liquid to the trough.

Figure 3:
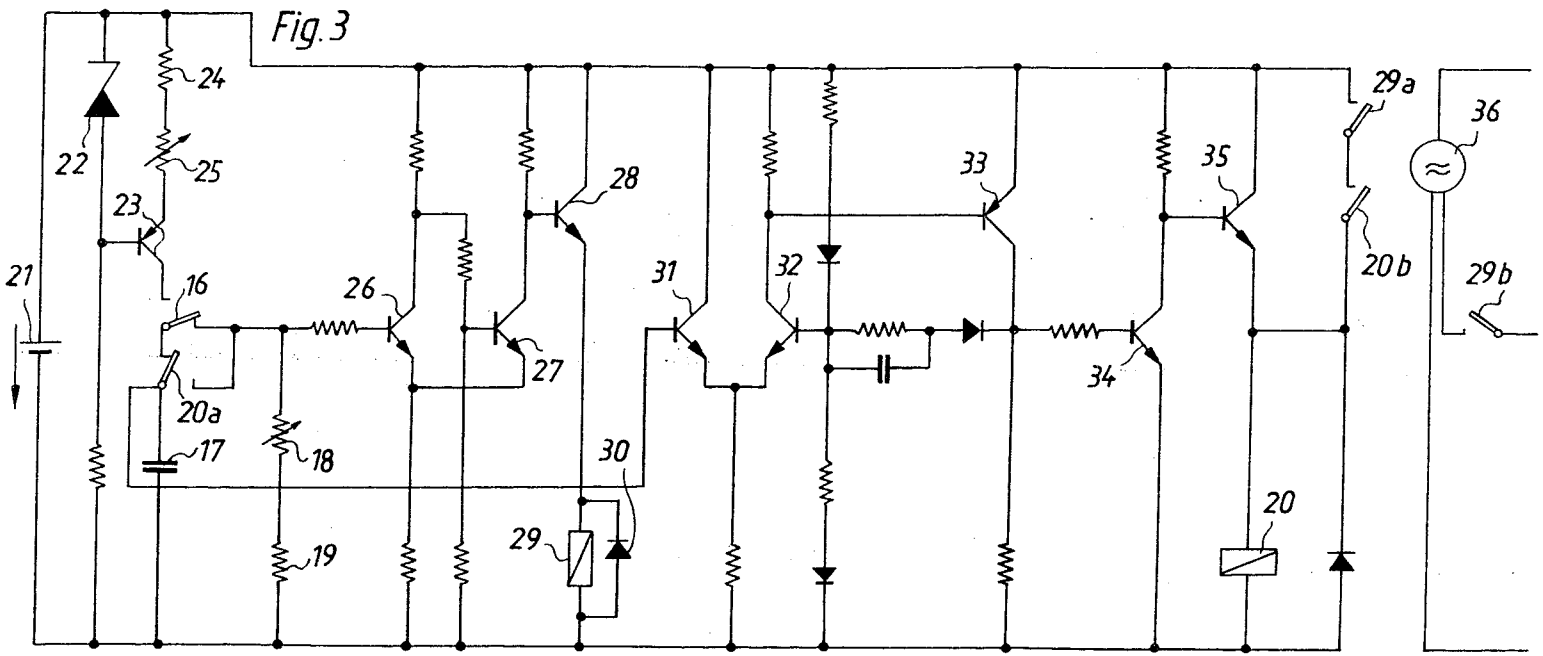
FIG. 3 shows a circuit diagram for control of the equipment shown in FIGS. 1 and 2.

FIG. 3 shows a circuit for controlling the motor driving pump 5. Not shown in FIGS. 1 and 2 is a switch whose moving arm is activated as soon as a photographic emulsion carrier is present within the equipment. This switch is herein referred to as scan means. It is shown as switch 16 in FIG. 3. As shown in FIG. 3, it is a selector switch which has a normally closed position in which a capacitor 17 is connected to ground through a normally closed contact 20*a* of a relay 20, and a variable resistor 18 connected in series with a fixed resistor 19. In its normally open condition switch 16 connects capacitor 17 to a constant current source. This comprises a battery 21, a Zener diode 22, a transistor 23 and emitter resistors 25 and 24 connected between the emitter of transistor 23 and the positive side of battery 21.

The circuit means for interconnecting the scan means (16) to the removing means (pump) comprise a first transistor 26 whose base is connected to one terminal of capacitor 17 when switch 16 is in its normally closed position. Transistor 26 together with a second transistor 27 forms a bistable stage, herein referred to as a first bistable stage. Connected to the collector of transistor 27 is the base of a transistor 28 which serves as output amplifier and has a relay coil 29 connected in its emitter circuit. Connected in parallel with relay coil 29 is a diode 30 which serves to suppress sparks.

Further, the base of a transistor 31 which serves as input transistor of a second bistable stage is directly connected to one terminal of capacitor 17. Connected to transistor 32 and 33 is transistor 31 to form the second bistable stage. Transistors 34 and 35 serve as power amplifiers, relay coil being connected into the emitter circuit of transistors 35. Further, connected in parallel with the emitter-collector circuit of transistor 35 is a pair of normally open contacts 29*a* and 20*b*, connected in series, and controlled, respectively, by relay 29 and 20. Relay 29 further controls a pair of normally open contacts 29*b* which, when closed, connect the second winding of motor 36, namely the winding which serves to increase the output of the motor, to the source of power.

The arrangement shown in FIGS. 1 and 2 cooperate with the circuitry shown in FIG. 3 to control relay 29 as follows: In the normally closed position of selector switch 16, as shown in FIG. 3, the photographic emulsion carrier is not present in bath container and motor 36 operates at a speed which corresponds to power being applied to only one of the windings. At this power output, liquid is taken in in the upper portion of the antechamber above centrifugal pump 5 and is pushed through the pipe 4 into the bath container 1*a*. Screw 9 is turned upward sufficiently so that the increase in pressure resulting from the decrease in cross-sectional area at the bottom of riser 10 is sufficiently small that the liquid level does not reach the run-off or discharge channel 11. Under these conditions, the treatment liquid circulates within through 1*a*, a quantity of fluid corresponding to the fluid entering the chamber in pipe 4 reaches the antechamber via overflow baffle 15 thus again arriving at the intake of the pump. Refilling from the bottle only occurs when the liquid level in the antechamber becomes less than the level of the supporting surfaces 13*a–d* so that air gets into the bottle from below. This can occur, for example, because of evaporation.

Under the above conditions, capacitor 17 is fully discharged through resistors 18 and 19. If the photographic emulsion carrier is now inserted between the transport cylinders 2 and is thus transported through the bath, switch 16 is switched to the position in which the collector of transistor 23 is connected to one terminal of capacitor 17. This connection is maintained for the whole time that the emulsion carrier is in the bath, the time in which the contact of switch 16 is in this position thus depending upon the transport velocity and the length of the emulsion carrier. The capacitor is charged linearly since, as explained above, it is charged from a constant current source. If it is first assumed that the effect of the second bistable stage is to be disregarded, this condition prevails until switch 16 is returned to the position shown in FIG. 3, that is until the emulsion carrier has passed completely through the bath. At this point switch 16 returns to the position shown in FIG. 3 causing capacitor 17 to be discharged through resistors 18 and 19. The resistance of resistors 18 and 19 is so chosen that the rate of discharge substantially exceeds the charging rate of capacitor 17. This causes the time at which the pump is operated at higher power output to be relatively short compared to the total operation of the equipment. This has the advantage that even for very small quantities of regenerating liquid per unit surface of the emulsion carrier the quantity of liquid being pumped is sufficient to prevent blocking of the apparatus even for relatively large cross-sections of pipe 4.

The switching of the first bistable stage to the second stable state when switch 16 returns to the position shown in FIG. 3 causes relay 29 to be energized and motor 36 to be switched to high power output for a time corresponding to the time during which capacitor 17 has a voltage which is still sufficiently high to prevent the first bistable stage from returning to the first stable state. Thus the voltage existing on capacitor 17 at the beginning of the discharge period serves as a measure of the amount of fresh liquid to be added. In the embodiment wherein the second bistable stage is disregarded, this quantity of liquid is added at one time after the emulsion carrier has passed through the bath. This is because, while motor 36 is operating at high power, the back pressure at the location of screw 9 causes the liquid level in riser 10 to increase so that a determined quantity of liquid passes through discharge channel 11 to a container for used liquid. The refill means mounted on surfaces 13*a–d* then cause liquid to be added in the antechamber until the liquid level in the antechamber again reaches the same level as in trough 1*a*.

This embodiment has the disadvantage that the pump is operated at a high output for a relatively long time.

Since fresh liquid is reaching the arrangement for a relatively long time, it is possible that this fresh liquid reaches the intake opening of the pump and then is discharged immediately over riser 10.

To prevent this it is first of all desirable to keep the distance between the opening of the bottle and the intake of the pump the maximum possible. This in practice has been found not to be sufficient in all cases. For this reason the remainder of the circuitry shown in FIG. 3 was added in order to cause the operation at high power to take place in a pulsating manner only.

Figure 4:
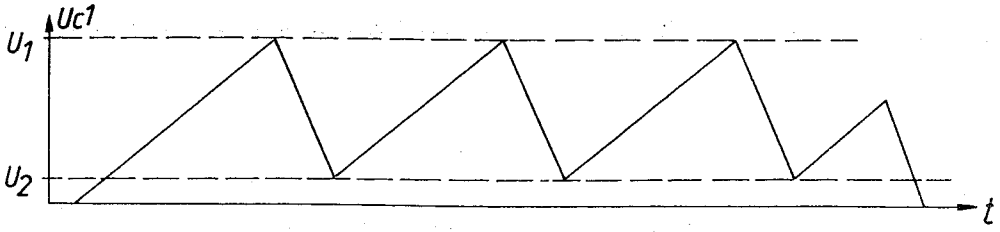
FIG. 4 is a plot capacitor voltage against time, showing the voltage across a storage capacitor in FIG. 3 and including the cut-in points of the liquid removing pump.

Under these conditions, that is also using the second bistable stage, the equipment operates as follows: Previously, capacitor 17 is assumed first to be completely discharged. This corresponds to the time axis in FIG. 4. When the photographic emulsion carrier is inserted, switch 16 then returns to the position not shown in FIG. 3. The resulting charging of capacitor 17 causes a voltage to appear at the base of transistor 31. The threshold voltage of this stage is, however, considerably higher than the threshold voltage of the first bistable stage. Relay 20 is thus energized only when the capacitor voltage reaches the level indicated by Ucl in FIG. 4. Energization of relay 20 causes the switching of contact 20*a* to the position not shown in FIG. 3. This causes the first bistable stage including transistor 26 to switch to the second stable state thus energizing relay 29. Further, holding contact 20*b* of relay 20 is also closed. Energization of relay 29 causes the switching to the high power output by means of closing of relay 29*b*. It further serves to close holding contact 29*a* so that relay 20 now remains energized independent of the voltage on capacitor 17. Capacitor 17 of course starts to discharge through resistors 18 and 19 because contact 20*a* is now closed. This corresponds to the descending linear portion of the curve shown in FIG. 4. It should be noted that the discharge curve of the capacitor is approximated as a straight line curve; this is an acceptable approximation in this operating region of the equipment.

The discharge of capacitor 17, with simultaneously high pump output, continues until the voltage across the capacitor is less than the threshold voltage for the first bistable stage. This causes relay 29 to be deenergized and switch 29*a* to open. The opening of switch 29*a* causes relay 20 to be deenergized, thus causing contact 20*a* to return to the position shown in FIG. 3. This causes capacitor 17 to be recharged, while the opening of contact 29*b* causes a reduction in the motor power. This cycle of charging of the capacitor and a subsequent discharge with a simiultaneous increase in the pump power continues until switch 16 returns to its original position when the emulsion carrier is no longer in the bath. It can of course happen that at this point capacitor 17 is below the level Ucl shown in FIG. 4. However, when switch 16 returns to the position shown in FIG. 3 capacitor 17 will discharge through resistors 18 and 19, causing the first bistable stage (transistors 26, 27) to switch to the second stable state energizing relay 29 as long as the voltage across capacitor 17 exceeds the level indicated by $U_2$ in FIG. 4. While relay 20 is not energized, the pump is still operated at a higher power because of the closing of switch 29*b*.

Instead of a pump operated at two different power outputs it is of course possible to use two separate pumps, one as circulating pump and the other as an exhaust pump. The exhaust pump is of course then connected to the contact 29*b* in FIG. 3.

Of course it is entirely within the teachings of the present invention that other circuits than the ones shown in FIG. 3 can be used to control the operation of the removing means. Integrated circuits can readily be used. Further, of course the AC motor of the present invention can be replaced by a DC motor which, to achieve a higher power, is connected to a higher voltage.

While the invention has been illustrated and described as embodied in using particular pumping and control circuit arrangements, it is not to be limited to the details shown, since various modifications and circuit changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In equipment for liquid treatment of photographic emulsion carriers, said equipment having a bath container for holding liquid for treating said emulsion carriers, said bath container having an overflow for limiting the maximum liquid level therein, an arrangement for adding fresh liquid to said bath container, comprising, in combination, scan means for sensing said emulsion carrier when in said bath container and furnishing a control signal when the quantity of so-sensed emulsion carrier has reached a predetermined quantity; removing means coupled to said scan means for forceably removing a determined quantity of liquid corresponding to said quantity of so-sensed emulsion carrier from said bath container in response to said control signal; and refill means operatively associated with said bath container for adding a quantity of fresh liquid corresponding to the so-removed quantity to said bath container.

2. In equipment for liquid treatment of photographic emulsion carriers, said equipment having a bath container for holding liquid for treating said emulsion carriers, said bath container having an overflow for limiting the maximum liquid level therein, an arrangement for adding fresh liquid to said bath container, comprising, in combination, scan means for sensing said emsulion carrier when in said bath container and furnishing a control signal when the quantity of so-sensed emulsion carrier has reached a predetermined quantity; removing means coupled to said scan means for forceably removing a determined quantity of liquid corresponding to said quantity of so-sensed emulsion carrier from said bath container in response to said control signal; and refill means responsive to the height of liquid in said bath container for adding a quantity of fresh liquid required for maintaining a predetermined minimum liquid level to said bath container whenever the liquid level therein is less than said predetermined minimum liquid level.

3. In equipment for liquid treatment of photographic emulsion carriers, said equipment having a bath container for holding liquid for treating said emulsion carriers, said bath container having an overflow for limiting the maximum liquid level therein, an arrangement for adding fresh liquid to said bath container, comprising, in combination, scan means for sensing said emulsion carrier when in said bath container and furnishing a control signal when the quantity of so-sensed emulsion carrier has reached a predetermined quantity; removing means coupled to said scan means for forceably removing a determined quantity of liquid corresponding to said quantity of so-sensed emulsion carrier from said bath container in response to said control signal, said removing means comprising pumping means for circulating said liquid in said bath container in response to a first power input and for removing said liquid from said bath container in response to a second power input exceeding said first power input; and refill means operatively associated with said bath container for adding a quantity of fresh liquid corresponding to the so-removed quantity to said bath container.

4. Equipment as set forth in claim 3, wherein said pumping means comprise a pump for pumping said liquid in said bath container, and a motor for driving said pump, said motor having a first and second winding; further comprising a power source; and means for connecting said first winding of said motor to said power source to effect said first power input and said second winding to said power source to effect said second power input.

5. Equipment as set forth in claim 3, wherein said pumping means comprise a pump, and a motor coupled to said pump for driving said pump, said motor having a first and second winding; further comprising a power source; and means for connecting only said first winding to said power source to effect said first power input and both said first and second winding to said power source to effect said second power input.

6. Equipment as set forth in claim 3, further comprising adjusting means for adjusting the quantity of liquid removed from said bath container by said pumping means per unit time.

7. Equipment as set forth in claim 6, wherein said pumping means comprise a pump having an exhaust pipe for furnishing circulated liquid; wherein said exhaust pipe has a branch connection; further comprising a riser connected to said branch connection and a drain for said liquid removed from said bath container connected to said riser; and wherein said adjusting means comprise means for adjusting the cross-sectional area of said exhaust pipe at a location following said branch connection in the direction of flow of said liquid.

8. An arrangement as set forth in claim 3, wherein said pumping means has an intake; and wherein said intake is positioned a maximum possible distance away from said refill means.

9. Equipment as set forth in claim 8, further comprising circuit means for connecting said scan means to said removing means in such a manner that said second power input is applied pulsatingly to said removing means for determined short time intervals during the time said scan means senses said emulsion carrier in said bath container.

10. Equipment as set forth in claim 9, wherein said circuit means connect said scan means to said removing means in such a manner that said second power input is applied to said removing means periodically for determined short time intervals, each of said short time intervals being less than the average time interval required for liquid to flow from said refill means to said intake of said pumping means.

11. Equipment as set forth in claim 10, wherein said scan means comprise a selector switch having a first state when sensing said emulsion carrier and a second state in the absence of said emulsion carrier, a capacitor connected to said selector switch, a constant current source connected to said capacitor when said selector switch is in said first state, and a discharge circuit connected to said capacitor when said selector switch is in said second state.

12. Equipment as set forth in claim 11, further comprising a bistable stage connected to said discharge circuit of said capacitor, said bistable stage having a first and second state and an input for receiving an input voltage, said bistable stage being in said first state when said input voltage is less than a predetermined threshold voltage and in said second state when said input voltage is greater than said predetermined threshold voltage; further comprising means connected to said bistable stage and said removing means for applying said second power input to said removing means when said bistable stage is in said second stage.

13. Equipment as set forth in claim 12, wherein said means for applying said second power input comprise a relay.

14. Equipment as set forth in claim 12, further comprising a second bistable stage having a first and second state and having an input connected to said capacitor, said second bistable stage having a first state when voltage across said capacitor is less than a predetermined capacitor voltage and said second state when the voltage across said capacitor is greater than a predetermined capacitor voltage; and a relay connected to said second bistable stage in such a manner that said relay is energized when said second bistable stage is in said second state and is deenergized when said second bistable stage is in said first state, said relay having contacts connected in parallel with said contacts of said selector switch.

15. Equipment as set forth in claim 14, wherein said discharge circuit has a variable resistor for varying said determined time interval.

* * * * *